United States Patent [19]

Benson

[11] 4,038,021

[45] July 26, 1977

[54] CONTINUOUS GRAIN DRIER AND METHOD

[76] Inventor: John O. Benson, Rte. No. 1, Box 28, Mayer, Minn. 55360

[21] Appl. No.: 673,934

[22] Filed: Apr. 5, 1976

[51] Int. Cl.[2] ..... F27B 7/08

[52] U.S. Cl. ..... 432/112; 34/128; 165/88; 432/107; 432/118

[58] Field of Search ..... 34/128, 140, 141, 142, 34/147; 432/112, 113, 118, 106, 107, 197; 165/88; 99/483, 443; 259/3, 16, 33, 85; 214/18 K

[56] References Cited

U.S. PATENT DOCUMENTS

| | | | |
|---|---|---|---|
| 161,865 | 4/1875 | Cook | 432/106 |
| 1,623,017 | 3/1927 | Christoph | 34/128 X |
| 2,019,179 | 10/1935 | Fasting | 432/106 X |
| 3,401,923 | 9/1968 | Bearce | 34/128 X |
| 3,787,292 | 1/1974 | Keappler | 432/107 X |

FOREIGN PATENT DOCUMENTS

| | | | |
|---|---|---|---|
| 634,981 | 3/1928 | France | 34/128 |
| 508,061 | 6/1939 | United Kingdom | 432/112 |

*Primary Examiner*—William F. O'Dea
*Assistant Examiner*—Harold Joyce
*Attorney, Agent, or Firm*—Stuart R. Peterson

[57] ABSTRACT

My continuous drier comprises an inclined tubular casing having a feed tube concentrically disposed therein via which the product, such as grain or seed, to be dried is delivered to the lower end of the casing. Circumscribed about the feed tube and in a fixed relation thereto is an auger having its peripheral edge secured to the interior of the tubular casing. Most of the flights of the auger are perforated, the holes being of a size sufficiently small so that the granular product will not pass therethrough, yet large enough to allow a heat conductive media, such as salt particles, to sift downwardly as the drier is rotated about its inclined axis. Whereas most of the auger is perforated, two flights adjacent the closed lower end of the casing are imperforate. A discharge opening is provided in that portion of the feed tube encircled by the imperforate flights, thereby enabling the granular product to be delivered into a region adjacent the lower end of the tubular casing which is devoid of any heat conductive particles. Heat is directed to the outside of the tubular casing, passing through the casing wall directly into the granular product and also to the product through the agency of the various heat conductive particles.

15 Claims, 4 Drawing Figures

CONTINUOUS GRAIN DRIER AND METHOD

BACKGROUND OF THE INVENTION

1. Field of the Invention

This invention relates generally to the drying of agricultural crops, and pertains more particularly to the continuous drying of seeds, grains, beans and the like.

2. Description of the Prior Art

Various types of crop driers have been devised. Generally, they are classified as either farm constructed driers or manufactured crop driers. Obviously, farm construction driers involving the installation of bins, blowers, permanent duct work and grain circulating apparatus can prove to be quite costly. Furthermore, the drying action is quite prolonged, particularly if unheated air is relied on. In most instances, the drier makes use of forced heated air which is passed through the crop to be dried. The large volume of air makes it such that the drying equipment has to be quite large, and even then the transfer of heat from the air to the crop being dried is a rather slow process. As far as the so-called manufactured driers are concerned, these frequently utilize extensive duct work too, even though of a more portable character.

Efforts to circulate the crop, which can be quite costly, as already explained, are also inadequate for the additional reason that to circulate any sizable quantities of the crop cannot be done fast enough to assure uniform drying.

SUMMARY OF THE INVENTION

Accordingly, a need exists for apparatus that will rapidly dry various types of agricultural crops of a granular nature in order to minimize product deterioration and the accompanying monetary loss that goes along with deterioration.

Another object is to effect a sufficient heating within an optimumly short period of time so as to effectively inactivate growth inhibitors and enzymes, particularly in such products as soy beans. Also, it is an aim of the invention to destroy mold and their spores, and other organisms adversely affecting certain granular crops, particularly some types of seeds. The short drying time is also beneficial in that it does not markedly denature proteins.

Another object of the invention is to lengthen the time that high moisture crops, such as corn, can be stored.

Still further, an object is to provide a more accurate control of the drying procedure, thereby permitting each type of crop to be dried to the moisture level best suited for that crop. Corn, for instance, that is either too wet or too dry does not have the sales or feed value of corn possessing a desired moisture content.

Also, an object of the invention is to provide equipment that will not only dry but also roast the product in the same operation. It is generally recognized that some types of crops, such as corn and beans, have their flavor enhanced by roasting. Where two separate and distinct operations are resorted to, there is not only a less efficient utilization of the heat owing to the cooling of the product in between, but there is an increase in the cost of the two operations by reason of the additional apparatus required for each operation. The time lost in transferring the product from the drier to the roaster and the cost of the conveying equipment are also adverse factors to be taken into account.

Yet another object is to provide a combined drying and roasting operation in which the roasting portion of the operation, by virtue of the rapidity with which it is achieved, produces a sterilization without allowing time for chemical changes to occur. Also, an aim of the invention is to effect any roasting in such a short period of time that if the product is brittle or frangible, excessive breakage will not result which would otherwise occur if the tumbling used in the roasting is spread over a needlessly long period of time.

Still another object is to provide apparatus that is efficient, both thermally and electrically, simple, compact, long lasting and inexpensive, both in initial cost and to operate, so as to encourage its widespread use on farms of all sizes, including relatively small farming operations, and also in various types of commerical operations. Contributing to the realization of good thermal efficiency is the ability of my drier to retain the heat conductive media within the confines of the tubular casing so that is is not discharged with the product and therefore does not require reheating which is necessary where heat conductive media is allowed to cool and be reintroduced into the drier. Also, where the heat conductive media is discharged along with the product, the two must, of course, be separated, thereby increasing the operational costs. Furthermore, the reduction in machine size results in the use of less metal, which reduces its initial cost, and at the same time minimizes its consumption of the electric power needed to rotate the drier.

A still further object of the invention is to employ a heat transfer media, such as common salt, that will not harm the product being dried. It is planned that the salt, which is in the form of fine particles, be recovered for re-use, thereby effecting a financial saving but even more importantly prevent the salt from contaminating the ecology.

Briefly, my invention envisages the mounting of a tubular casing for rotation about an inclined axis. By means of a concentrically disposed feed tube having an auger circumscribed thereabout, the product to be dried is delivered to the closed lower end of the tubular casing, there being a discharge opening adjacent the lower end of the feed tube via which the product is discharged into the casing. The auger is fixedly secured to the feed tube and extends outwardly into fixed engagement with the interior of the casing so that no clearance or space exists between either the feed tube or the casing. The auger is perforated throughout the major portion of its length, the holes of a size so as to permit heat conductive particles to sift downwardly as the product to be dried is augered upwardly. The perforations do not extend throughout the entire length of the auger; the two lowermost flights are imperforate so that the discharge or delivery of the product to be dried takes place in a region devoid of the particulate heat transfer media. Preferably, the heat conductive media is ordinary salt, the salt freely passing through the perforations or holes in the auger whereas the granular product, being of larger size than the holes, is moved upwardly. The salt particles receive heat transmitted through the walls of the tubular casing and transfer the heat they have received to the product requiring drying. In addition to the heating via the heat transfer media, there is a direct heating of the product due to its contact with the inside or interior of the tubular casing. The steam or vapor developed during the drying process is confined within the tubular casing, being constrained to flow, actually being forced, upwardly with the granular product being dried, and exits at the upper end of the casing where it is vented upwardly as the dried product falls downwardly. The fine salt particles carried by the vapor are preferably recaptured.

DESCRIPTION OF THE PREFERRED EMBODIMENT

Figures 1, 2:
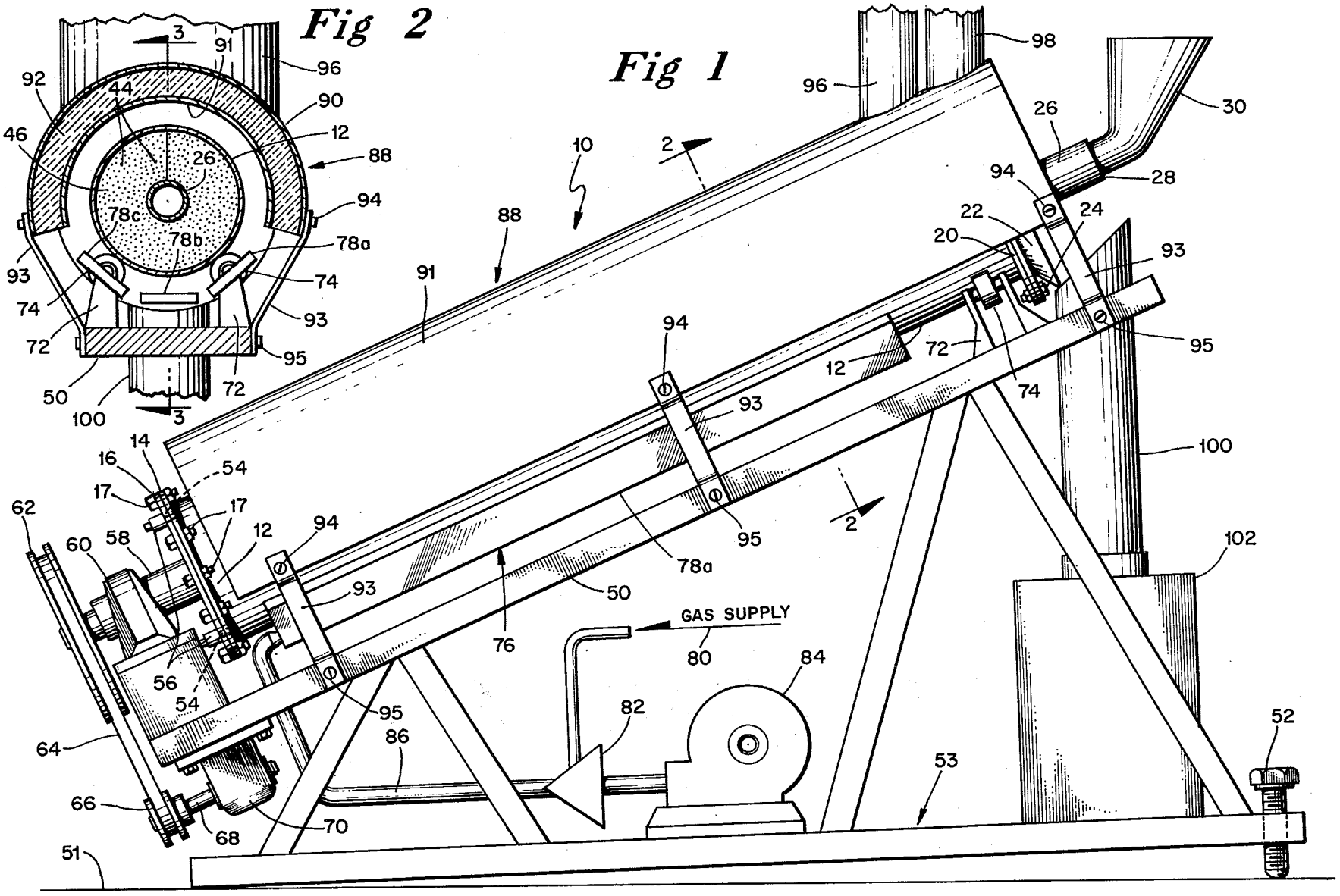
FIG. 1 is a side elevational view of my grain drier.
FIG. 2 is a sectional view taken in the direction of line 2—2 of FIG. 1.

The continuous drier exemplifying my invention has been denoted generally by the reference numeral 10. The drier 10 includes a tubular stainless steel casing 12 having an annular flange 14 at its lower end to which is secured a circular plate 16 by means of bolts and nuts 17 so as to completely close this end of the casing. The bottom plate 16 provides a way for rotating the casing about an inclined axis as will be later described.

Unlike the lower end, the upper end 18 of the tubular casing 12 remains open. A second annular flange 20 is affixed to the upper end 18 which flange 20 enables a similarly flanged frusto-conical deflector 22 to be attached by means of bolts and nuts 24. The flared configuration of the upper deflector 22 facilitates the discharging of the dried product, as will hereinafter become clearer.

At this time, attention is directed to a feed tube 26 of mild steel concentrically disposed within the interior of the tubular casing 12. The feed tube 26 has an inlet at 28. A funnel-like guide 30 directs the product to be dried into the casing 12 and also the heat conductive particles, both not yet specifically referred to, into the upper end 28 of the feed tube 26. Inasmuch as the feed tube 26 rotates about the same inclined axis as the tubular casing 12, as will soon be made manifest, the lower end 32 of the guide 30 has a slip fit with respect to the upper end 28 of the feed tube 26. The lower end 34 of the feed tube 26 abuts against the plate 16, and in one side thereof has a discharge opening 36 via which the product and heat conductive particles are delivered into the region adjacent the plate 14 at the lower end of the tubular casing 12.

Circumscribed about the feed tube 26 is an auger 38, which like the feed tube 26 may be fabricated from mild steel. More specifically, the inner helical edge 40 of the auger 38 is secured to the feed tube 26, as by seam welding, whereas the outer or peripheral helical edge 42 is secured to the tubular casing 12, as by spot welding from the outside in a helical path through the casing to the auger. Of importance in practicing the invention is the fact that the major portion of the longitudinal length of the auger has a number of perforations or small holes 44 formed therein. The total number of flights is susceptible to variation. However, the various perforated flights have been labeled 46 in FIG. 3, and the two that are not perforated have been labeled 48. The reason for the imperforate flights 48 will be described below.

Thus, even though the heat conductive particles are fed into the upper end 28 of the feed tube 26 and flow gravitationally down through the feed tube into the lower portion of the tubular casing 12, once they leave the feed tube 26 and are augered or advanced upwardly, the heat conductive particles cannot return to the lower region of the tubular casing 12 owing to the imperforate configuration of the two lowermost flights 48. Consequently, the lowermost region will not become packed by virtue of enough heat conductive particles collecting in that particular portion of the drier 10. By having no perforations in the lower two flights 48, the heat transfer media or heat conductive particles are retained above this region. In other words, the heat conductive particles, plus any used in replenising the supply of heat transfer media, will initially enter via the discharge opening 36, but once the media is augered upwardly, it can only sift back downwardly through the perforations and is for all intents and purposes blocked as soon as it gets to the upper imperforate flight of the two labeled 48.

It will be appreciated that the tubular casing 12, the feed tube 26 and the auger 38 all rotate in unison by reason of the auger being secured to both the casing 12 and the tube 26. Since the drier 10 comprised of the parts 12, 26 and 38 is to rotate about an inclined axis, a bed plate 50 is held at an appropriate angle with respect to the horizontal 51 by means of jacking bolts 52 threadedly received in the forward end portion of a supporting framework 53 underlying the bed plate 50. An angle of 26° has been found satisfactory in actual practice for an auger having an 8 inch diameter and a pitch of 4 inches for the flights 46, 48. The speed at which the drier 10 is rotated becomes important for the parameters just given and will be dealt with shortly.

It is of decided advantage to have the lower end of the tubular casing 12 completely sealed during the drying operation. The circular plate or disc 16 does this. However, at times it will be desirable to remove the heat conductive media from the tubular casing 12. Therefore, two tapped holes 54 are formed in the plate 16, being spaced 180° apart. The holes are normally closed by plugs 56 which are taken out when the heat conductive media is to be removed, reverse rotation (opposite to that used during drying) of the tubular casing 12 causing such media to be discharged via the holes 54 during the reverse rotation.

The plate 16 provides a means for rotating the tubular casing 12, either during drying (when the holes 54 are closed by the plugs 56) or to remove the heat conductive media (when the holes are open). In this regard, a drive shaft 58 has one end affixed to the plate 16 and extends in axial alignment from this plate, passing through a bearing labeled 60. Although a separate thrust bearing could be used, the bearing 60 is preferably of a type to resist the tendency of the tubular casing 12 to move downwardly (owing to its inclination) and to journal the shaft 58. A pulley 62 attached to the other end of the shaft 58 has a flexible belt 64 entrained thereabout, the belt 64 also passing about a pulley 66 mounted on the shaft 68 of a reversible electric motor 70.

Extending upwardly from the inclined bed plate 50 are a plurality of standards 72, each having a roller 74 at its upper end. The rollers 74 support the upper end of the tubular casing 12 and, of course, enable it to be rotated about its inclined axis. Thus, the shaft 58 serves as a driving means and support for the lower end of the casing. The rollers 74 also permit longitudinal expansion of the casing 12 to take place.

Although of conventional design, a gas burner system 76 is located beneath the tubular casing 12. More specifically, the system 76, which is presented only diagrammatically because it is conventional, consists of three so-called line burners 78*a,* 78*b,* 78*c,* the one identified as 78*b* being directly beneath the tubular casing 12 as can be discerned from FIG. 2 and the other two burners 78*a,* 78*c* slightly to either side of the lower one 78*b.* A gas supply 80 furnishes gas to a mixer 82 that also receives air from an air supply 84, such as an air blower. By reason of a manifold 86, the mixed gas and air is fed to the three burners 78*a,* 78*b,* 78*c.*

A generally semicircular heat shield or hood 88 overlies the tubular casing 12 so as to cause the heat supplied by the burners 78 to envelope substantially the entire circumference of the tubular casing 12, as well as a major portion of its length. In the illustrated instance, the shield or hood 88 is comprised of inner and outer metal sheets 90, 91 and an intermediate layer of thermal insulation 92. The shield or hood 88 is supported by a number of strips or brackets 93, the ends of which are anchored by screws 94 and 95, the latter being threaded into the bed plate 50. The burners 78 can vary in their length, depending upon the length of the casing 12, usually being several feet or so shorter than the casing 12.

In addition to providing a better distribution of the heat about the tubular casing 12, the shield or hood 88 also functions as a guide so as to channel the products of combustion upwardly along the tubular casing 12 to a location near its upper end 18. At this location there is an upwardly extending burner chimney 96 into which flow the hot gases from beneath the heat shield 88 so as to be suitably exhausted to the air outside whatever building houses my drier 10. Also, there is a vapor vent 98 extending upwardly from the upper end 18 of the casing 12. Consequently, the vapor which contains salt dust (if salt is used as the heat conductive media as will be described shortly) should be directed into an appropriate recovery system (not shown). It will be recognized from additional descriptive information to be given that the heat conductive particles themselves do not leave the tubular casing 12.

For a number of reasons, ordinary salt, NaCl, is preferable as the heat conductive material. Notable amongst the advantages is the low cost of salt. Being a food ingredient, salt has the added advantage of not contaminating food grains when such a product is being dried. Also, it is an excellent heat conductor and its small particle size makes it such that it almost fully enrobes the granular material to be dried. The corrosiveness and the polluting characteristics of salt virtually necessitate the employment of some form of recovery system. The salt in this situation readily flows or is sifted downwardly through the various perforations or small holes 44 formed in the flights 46 of the auger 38. These holes 44 should be on the order of 150 inch in diameter. However, the holes 44 must be small enough so as to resist any downward or gravitational flow of the product being dried.

It is contemplated that my drier 10 will have especial utility in the drying of corn that comes directly from a picker-sheller harvester. Corn arriving from the harvester usually contains 26–30% moisture and must be dried down to 14–16% moisture. My drier permits this to be done in only 20 seconds. Whereas the heat conductive particles are preferably grains of ordinary salt, it will be recognized that sand, metal shot or virtually any granular material that will be conduct heat and yet will not melt when subjected to temperatures on the order of from 500°–600° F. could be used. Normal drying or roasting temperatures are around 400° F. The 400° F. figure is a median temperature, somewhat lower temperatures being practical for longer drying times and even higher temperatures for shorter times. The precise drying time is influenced by the particular agricultural crop being dried, the mentioned 400° F. temperature being ideal for corn.

Quite obviously, the speed or rate at which the tubular casing 12 is rotated must be correlated with the dimensional parameters already given. Actually, for a 7 foot, 9 inch length auger having the previously mentioned 8 inch diameter, 4 inch pitch and 26° inclination with the horizontal 51, and desiring a 20 second retention period, a rotative rate of 70 rpm becomes the proper speed. Strictly speaking, this would be the distance traversed by the granular product to be dried from the opening 36 where it is introduced "wet" to the upper end 18 of the tubular casing 12 where it is gravitationally discharged via a downwardly directed chute 100 into a receiving bin 102. In practice, the auger 38 just described would be somewhat longer than the 7 foot, 9 inch effective length mentioned. In other words, for such a 7 foot, 9 inch length and a 4 inch pitch there would be 23 flights (21 perforate flights 46 and two imperforate flights 48). To assure that none of the heat conductive media is discharged with the product being dried, even more flights 46 would be employed, for instance seven more, making a total of 30. These last-mentioned flights 46 would extend beyond the burners 78, because the drying would have by then been completed. The angle of inclination becomes important too, in order to achieve a sufficient sifting and preclude the discharge of salt with the product, it has been given as 26°, but can be varied via the jacking bolts 52. If roasting is desired, even more flights 46 would be added, the burners 78 being appropriately lengthened so as to complete both the drying and roasting prior to discharging the product.

Figures 3, 4:
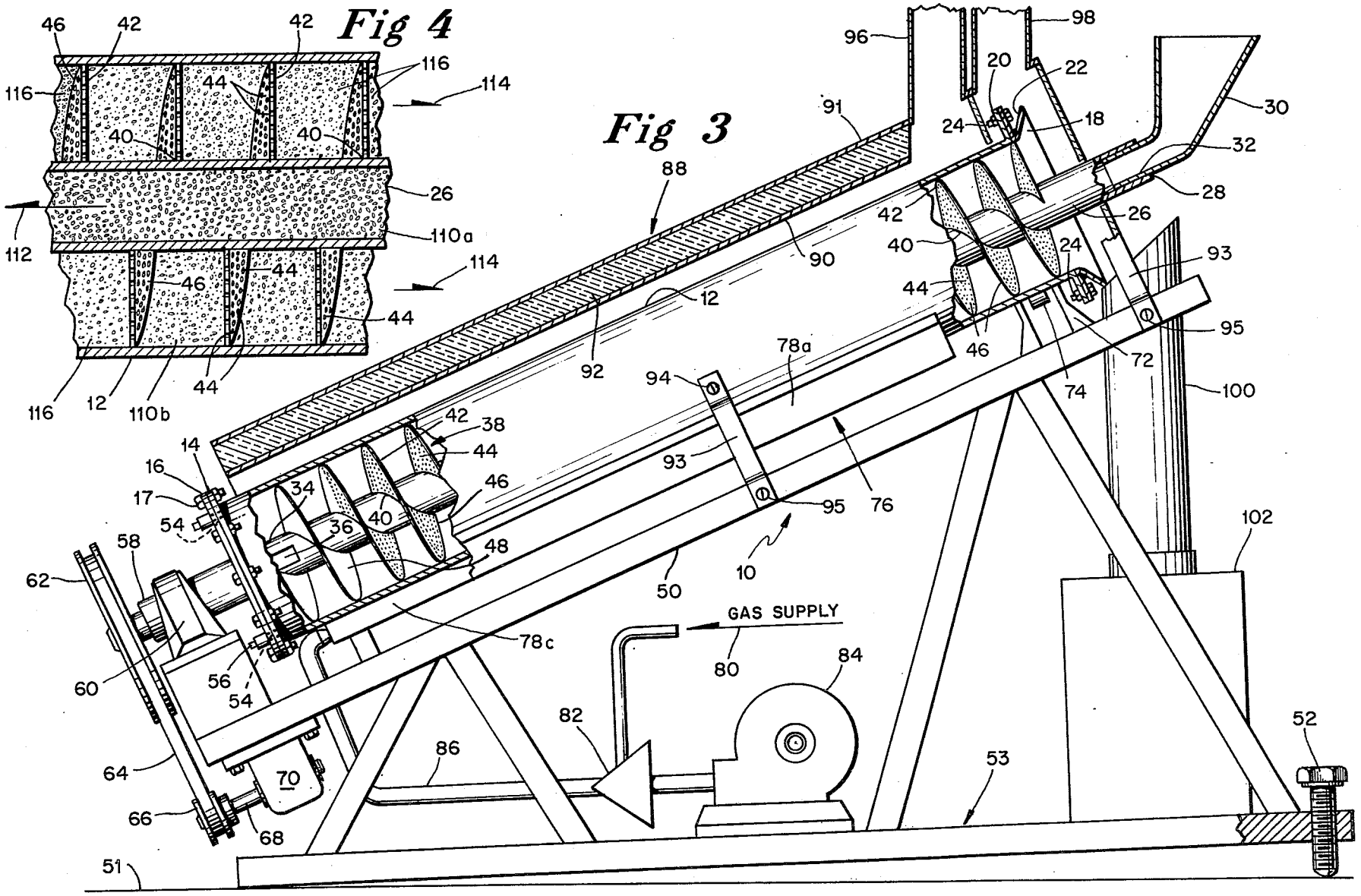
FIG. 3 is a longitudinal sectional view taken in the direction of line 3—3 of FIG. 2.
FIG. 4 is an enlarged fragmentary view corresponding to FIG. 2, but with the feed tube appearing in section with the granular product to be dried flowing downwardly therethrough and with the auger also shown in section with the granular product being moved upwardly and the heat conductive particles remaining generally at the depicted elevation by reason of perforations having a size slightly larger than the heat conductive particles.

In an effort to explain pictorially what happens, attention is now directed to FIG. 4 where the granular product in its still "wet" state has been given the reference numeral 110*a,* flowing downwardly through the feed tube 26 in the direction of the arrow 112. Although the opening 36 is not shown in FIG. 4, it will be appreciated from FIG. 3 that the product 110*a* enters the region formed by the imperforate flights 48 through the opening 36. It is then augered upwardly between the feed tube 26 and the tubular casing 12 in the direction of the arrow 114. Since its "wet" state is now being changed, the granular product during the drying procedure carries the reference numeral 110*b.*

It should be recognized from the foregoing that no clearance or space exists between the auger 38 and either the tubular casing 14 or the feed tube 26. Consequently, the product 110*b,* as it is being dried, can be made to fill, together with the salt particles (shown as dots and labeled 116 in FIG. 4), the entire annular space between the feed tube 26 and the tubular casing 12. Because of this, no reliance is made on any flow of air in achieving the drying action. This is of distinct advantage because the heat conductive material 116, salt in the illustrative instance, is far superior to air as a heat transfer medium in transmitting heat received through the casing 12 from the gas burners 78*a*, 78*b*, 78*c*.

Also, the resulting steam from the moisture driven off from the product being dried is forced by the flights 46, 48 upwardly and is literally pushed out through the open upper end 18 because this is the only escape route. In this way, the steam is not permitted to condense and drop back on any portion of the product as it travels through the tubular casing 12 and is being progressively dried. Not only is this advantage gained, but the confining of the steam to a direct route, this being via the vent 98, allows virtually all the salt dust carried therein to be removed through the agency of an appropriate recovery system. Where a corrosive heat conductive material, such as salt, is employed, not only is its discharge as a pollutant to the atmosphere obviated when utilizing the teachings of my invention, but the recovery thereof virtually eliminates any need for purchasing replacement salt.

With continued reference to FIG. 4, it will be perceived that the granular product 110*b*, the kernels constituting the product being represented by small circles, is of a size larger than the small holes or perforations 44 formed in the flights 46. Hence, the material 110*b* is forced upwardly as the auger 38 is rotated by the motor 70. However, the salt particles 116, being smaller than the perforations 44, are sifted back through the flights 46, being jostled about in the process so that the particles are at times in contact with the tubular casing 12, picking up the most heat then, and at times close to the feed tube 26. The inclination of the casing 12, specifically 26°, is selected so that the salt particles 116 remain at substantially the same elevation during the dryness process. To assure that they are never augered completely upwardly, the extra perforated flights 46 hereinbefore mentioned can be added, the additional flights acting to advance the product 110*b*, but furnishing additional sifting of the particles so that they do not reach the upper end 18. Consequently, no subsequent separation of the completely dried product, which is collected in the bin 102 is needed, for no salt 116 passes out of the casing 12 via its upper end. This is a distinct dual advantage because any later separation is a time-consuming and costly burden; also the salt particles 116, if mixed with the dried product, would cool and have to be reheated when used again.

On the other hand, if the particles 116 are to be removed at any time, then the plugs 56 are taken out and the auger 38 rotated in a clockwise direction, as viewed in FIG. 2, in contradistinction to the normal counterclockwise direction during the drying operation. The salt 116 then flows downwardly through the two holes 54. As is believed evident, it is only necessary to reverse the motor 70 to do this.

In summary, one cannot minimize the benefits to be derived from a rapid drying of most agricultural crops, especially corn, wheat, beans and certain seed species. When utilizing the rapid drying techniques of my invention, the drier 10 can be quite compact, the small size requiring very little electric power for rotating the unit composed of the tubular casing 12, the feed tube 26 and the auger 38 held therebetween. Actually, the motor 70 can be just a 1.0 H.P. one. Virtually all of the heat furnished by the burners 78*a*, 78*b*, 78*c* can be utilized. Also, the heat conductive particles, such as salt, are not permitted to cool, as they would if discharged with the dried product. The quick drying, it will be appreciated, destroys molds and spores that would otherwise adversely affect the product, this being particularly desirable as far as seeds are concerned.

If roasting is desired, the length of the tubular casing 12, the auger 38 and the burners 78 can be increased to whatever length is needed to effect the roasting. The roasting capability is a decided advantage in that it can be done in only one uninterrupted step. Not only is there a savings as far as not having to transfer the product, if roasting is desired, from one piece of equipment to another, but the overall thermal efficiency is enhanced because the product after the drying stage is not permitted to cool and need not be reheated for the roasting stage. Here again, the heat conductive particles do not have a chance to cool down, since the same particles would be continued to be used in the roasting phase of the continuous operation. Consequently, the heat that is supplied is more effectively utilized in a combined drying-roasting operation.

I claim:

1. A continuous drier including a tubular casing mounted at an inclined axis for containing both a granular product to be dried and a heat transfer media in the form of heat conductive particles, a feed tube having the major longitudinal portion thereof concentrically disposed within said casing for feeding said product through the upper end of said casing into the casing adjacent the lower end thereof, a helical auger rotatable about said inclined axis having its outer edge engaging the interior of said casing and its inner edge engaging said feed tube, at least a portion of said auger having perforations therein of a size generally smaller than the grains constituting said product and generally larger than said particles constituting said heat transfer media so that said heat transfer media can sift downwardly as said product is advanced upwardly, and means for directing heat against the outside of said casing so that at least some of the heat transmitted through said casing is conducted to said product via said heat transfer media.

2. A continuous drier in accordance with claim 1 in which said tubular casing and feed tube are also rotatable about said inclined axis.

3. A continuous drier in accordance with claim 2 in which said tubular casing, feed tube and helical auger are rotatable as a unit abut said inclined axis.

4. A continuous drier in accordance with claim 3 including means for varying the angle of said inclined axis.

5. A continuous drier in accordance with claim 1 in which said feed tube has a discharge opening near the lower end thereof through which said product is delivered into the lower end of said casing, said auger being imperforate adjacent said discharge opening so that the product to be dried is delivered into said casing in a region devoid of heat transfer media.

6. A continuous drier in accordance with claim 5 in which the outer edge of said auger is secured to said tubular casing and the inner edge thereof is secured to said feed tube, and means for rotating said tubular casing and the feed tube and auger contained therein at a preferred rate.

7. A continuous drier in accordance with claim 1 including a plurality of rollers underlying a section of said tubular casing for at least assisting in the supporting of said casing for rotation about said inclined axis.

8. A continuous drier in accordance with claim 7 in which said tubular casing has a plate at the lower end thereof, and a drive shaft extending from said plate by which said tubular casing can be rotated.

9. A continuous drier in accordance with claim 8 in which said plate has at least one hole therein, and a removable plug normally closing said hole.

10. A continuous drier in accordance with claim 8 including a bearing journaling said drive shaft, said bearing supporting the lower end of said tubular casing via said drive shaft and plate, and said rollers being located near the upper end of said tubular casing for supporting the upper end of said casing.

11. A continuous drier in accordance with claim 10 including an elongated burner underlying a longitudinal portion of said casing between said plate and said rollers.

12. A continuous drier in accordance with claim 11 including a generally semicylindrical hood overlying the top and sides of said tubular casing in a spaced relation with said casing so as to cause heat from said burner to also flow along the top and sides of said casing.

13. A continuous drier in accordance with claim 12 including a chimney at the upper end of said hood.

14. A continuous drier in accordance with claim 13 including a vent stack at the upper end of said tubular casing.

15. A continuous drier in accordance with claim 1 including means for rotating said casing at a rate in relation to the rate at which said granular product is fed through said feed tube such that said granular product and heat transfer media substantially fill the space between most of the flights constituting said auger.

* * * * *